US007708597B2

(12) United States Patent
Hu et al.

(10) Patent No.: US 7,708,597 B2
(45) Date of Patent: May 4, 2010

(54) CARD CONNECTOR WITH SHELL

(75) Inventors: Lan-Ping Hu, ShenZhen (CN); Yong-Hui Hu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/384,739

(22) Filed: Apr. 8, 2009

(65) Prior Publication Data

US 2010/0081326 A1 Apr. 1, 2010

(30) Foreign Application Priority Data

Apr. 8, 2008 (CN) ..... 2008 2 0035028 U

(51) Int. Cl.
*H01R 24/00* (2006.01)

(52) U.S. Cl. ..... 439/630

(58) Field of Classification Search ..... 439/630, 439/326, 654, 638, 945
See application file for complete search history.

(56) References Cited

U.S. PATENT DOCUMENTS 7,125,258 B2 * 10/2006 Nakakubo et al. ..... 439/64
7,568,952 B2 * 8/2009 Long et al. ..... 439/630
7,568,953 B1 * 8/2009 Ho et al. ..... 439/630
7,621,783 B1 * 11/2009 Lai ..... 439/630

* cited by examiner

*Primary Examiner*—Khiem Nguyen
(74) *Attorney, Agent, or Firm*—Ming Chieh Chang; Wei Te Chung; Andrew C. Cheng

(57) ABSTRACT

An electrical card connector 100 includes a dielectric housing or base 1, a number of contacts 2 received in the housing or base 1, and a metal shell 3 covering the housing or base 1, both sides of the housing or base 1 having passageways or positioning slot 10, both side of the metal shell 3 having beams 321 embedded into the passageways or positioning slot 10. The beams 321 mating the passageways or positioning slot 10 in an elongated direction increase the function area between beams 321 and passageways or positioning slot 10, which makes the electrical card connector 100 stable.

7 Claims, 7 Drawing Sheets

CARD CONNECTOR WITH SHELL

FIELD OF THE INVENTION

The present invention is generally related to the art of card connector and more particularly to an card connector having a dielectric base and a shell covering the dielectric base.

DESCRIPTION OF RELATED ART

The reduced size of mobile components steps with the tides of mobile phone miniaturization and multimerization. The trend needs the electrical card connector to be lighter, thinner, shorter, and smaller.

An electrical card connector disclosed in TW patent 281319 comprises an dielectric housing or base, a number of contacts received in the housing or base, and a metal shell covering the dielectric housing or base, the centre of two sides of the housing or base extending protrusions, the bottom portion of the side of protrusions having grooves, the metal shell places protecting pieces and fins or tabs, the protecting pieces dispose mating holes, said protrusions were inserted into said mating holes, said ribs hold the grooves.

TW 291105 patent discloses another electrical card connector, said electrical card connector comprises a dielectric housing or base, a number of contacts received in the housing or base, and a metal shell covering the housing or base, the central portion of two side of the dielectric housing or base project protrusions, the metal shell has mating holes corresponding to the protrusions, the protrusions can be inserted into the mating holes.

The above-mentioned two references disclosed a structure that a protrusion mates a mating hole, the mating area of this structure is limited, it makes the metallic shell easy to be broken off from the dielectric housing or base.

Hence, an improved card connector is required to overcome the disadvantages of the prior art.

SUMMARY OF THE INVENTION

Accordingly, an object of the present invention is to provide an electrical card connector that metal shell securely assembled with the housing or base.

In order to achieve the above-mentioned object, the present invention supplies an electrical card connector comprising: a dielectric housing or base, numbers of contacts received in the housing or base, and a metallic shell covering the housing or base, the both sides of the housing or base having passageways or positioning slot, the both side of the metal shell having beams embedded/disposed in the passageways or positioning slot. The beams mating the passageways or positioning slot in elongated direction increase the function area between beams and passageways or positioning slot. It makes the electrical card connector stable.

DETAILED DESCRIPTION OF THE INVENTION

Reference will now be made in detail to the preferred embodiment of the present invention.

Referring to FIGS. 1-7, an embodiment of the present invention is illustrated.

Figure 1:
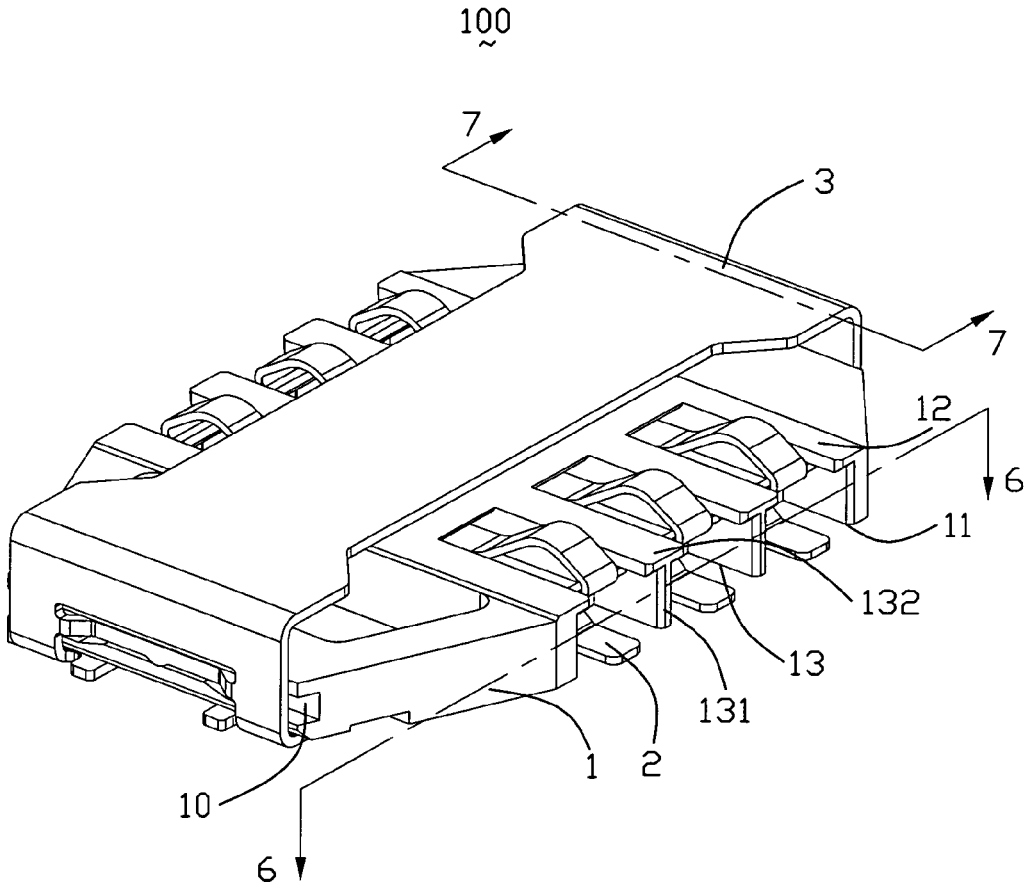
FIG. 1 is an assembled, perspective view of a card connector.

FIG. 1 is an assembled, perspective view of the electrical card connector 100, it discloses the spatial location relationship of the components of the electrical card connector 100.

Figure 2:
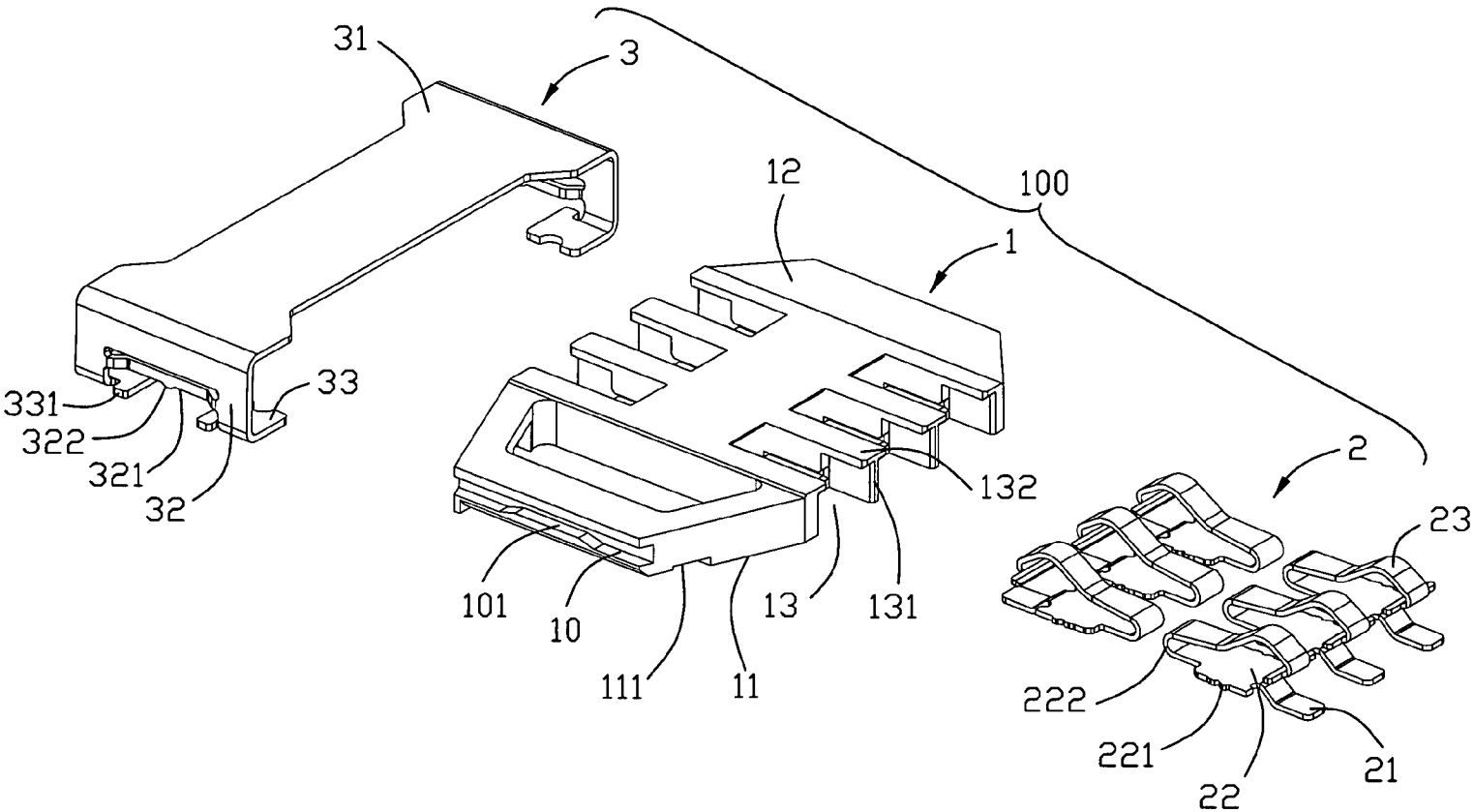
FIG. 2 is an exploded, perspective view of the card connector shown in FIG. 1.
Figure 3:
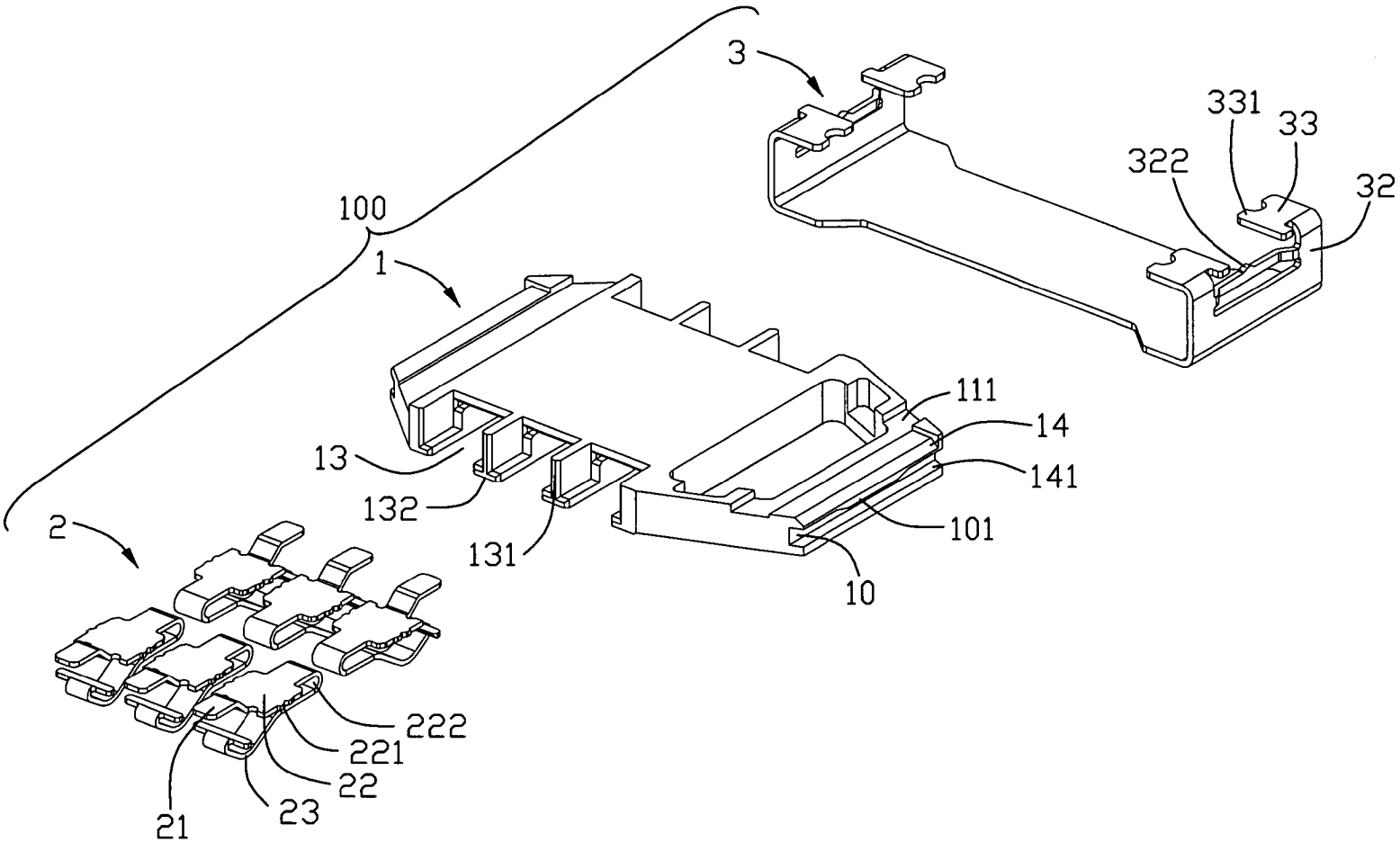
FIG. 3 is another exploded, perspective view of the card connector shown in FIG. 1.

FIG. 2 & FIG. 3 are exploded, perspective views of the electrical card connector as shown in FIG. 1; it illustrates the structure of the components in detail.

The electrical card connector 100 comprises: a dielectric housing or base 1, a plurality of contacts 2 received in housing or base 1, and a metallic shell 3 covering the top of the housing or base 1.

The dielectric housing or base 1 is made of a plastic material; the front and rear end of flat plate-shaped housing or base 1 are arranged symmetrically. Said housing or base 1 includes a mounting face 11 and the opposite supporting face 12, there are contact slots 13 receiving the contacts 2 and arranging in front and real rows. Numbers of walls 131 are disposed between the contact slots 13, numbers of eaves 132 extend from the walls 131. Lateral walls 14 of the housing or base 1 have passageways or positioning slot 10 extending in an elongated direction of the housing or base 1, at least one of two ends of the passageways or positioning slot 10 has a gap 141 for mating metal shell 3. A step portion or protrusion 101 is placed in the passageway 10.

Each contact 2 includes soldering portion 21, connecting portion 22, and touching portion 23. Said connecting portion 22 extends an elastic arm 222 and stretches thorns 221, the thorns 221 pierce through said housing or base 1 for maintaining the stable of the contact 2.

Said metal shell 3 stamped by a sheet metal comprises a top wall 31 and a pair of protecting pieces 32 extending from both sides of the top wall 31, the two ends of the protecting pieces 32 extend to each other forming a pair of fins or tabs 33, the fins or tabs 33 have holding foot 331, said housing or base 1 places holding recess 111 for receiving said holding foot 331. Said protecting pieces 32 form beams 321 inserted into the passageway 10, said beams 321 project protrusions 322, said protrusions 322 mate the step portion or protrusion 101.

Figure 4:
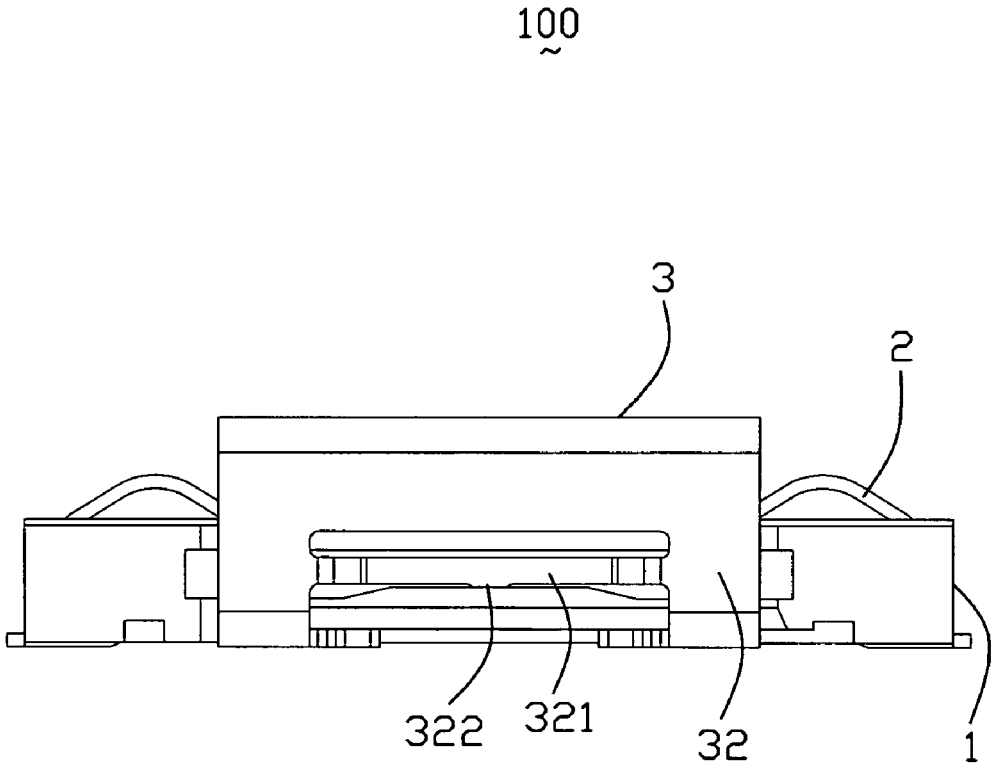
FIG. 4 is a left view of the card connector as shown in FIG. 1.
Figure 5:
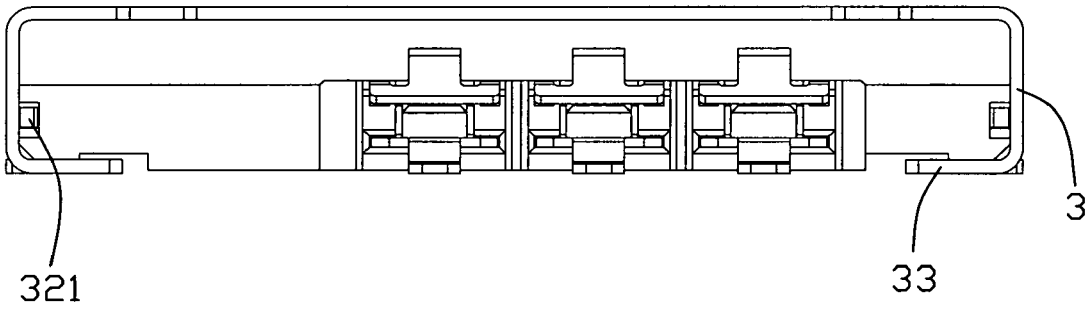
FIG. 5 is a front elevation view of the electrical connector shown in FIG. 1.
Figure 6:
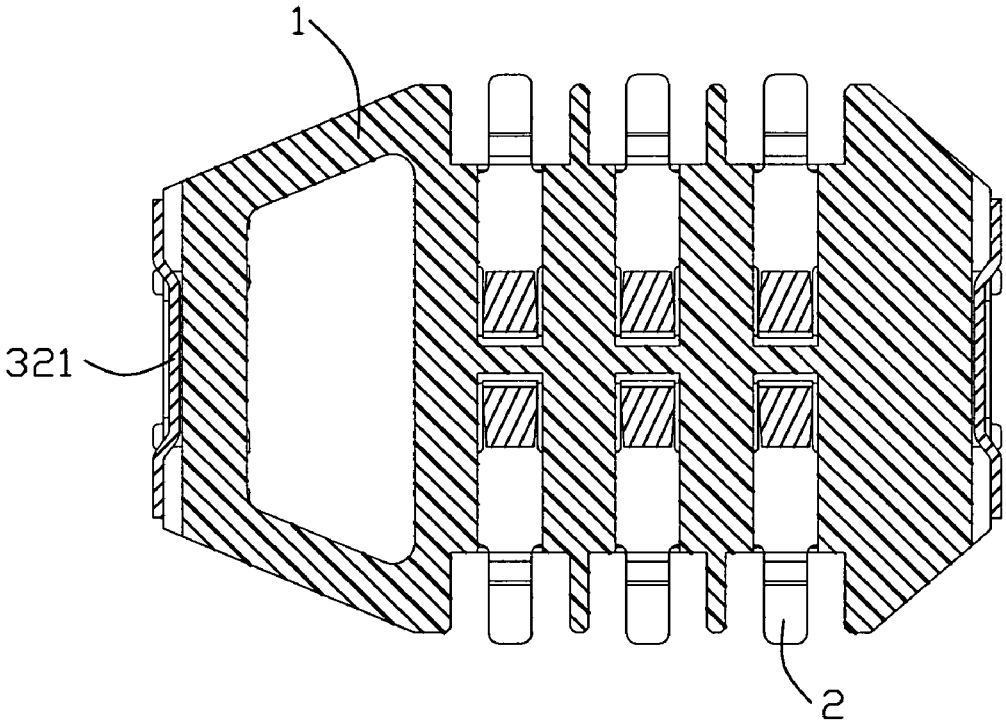
FIG. 6 is a cross-section view of the card connector taken along line 6-6 in FIG. 1.
Figure 7:
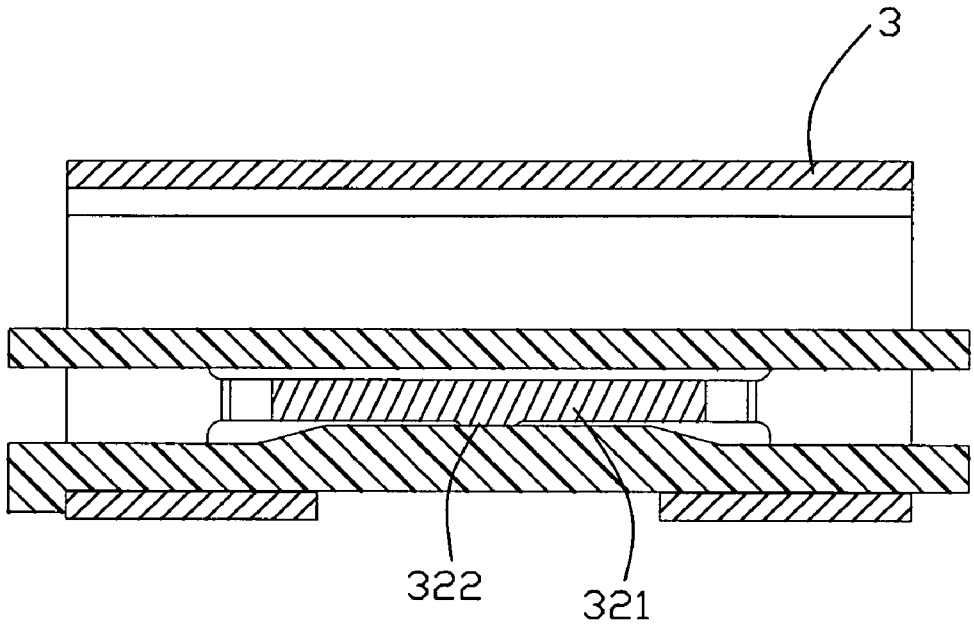
FIG. 7 is a cross-section view of the card connector taken along line 7-7 in FIG. 1

When assembled, contacts 2 are inserted into the contact slots 13, said beams 321 is slidable (sliding) into the passageway 10, the protrusions 322 and the step portion or protrusion 101 mating each other makes the metal shell 3 and the housing or base 1 be assembled properly, as shown in FIG. 4.

Thus, the whole electrical card connector 100 are assembled, the structure of beams 321 mating passageways or positioning slot 10 increases the function area of between the housing or base 1 and the metal shell 3, strengthens the stable of the electrical card connector 100.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical card connector, comprising: a flat dielectric base having passageways in both sides; and a shell including a top cover shielding the base and a pair of opposite lateral walls, each said lateral wall forming a beam inwardly to a space defined by said top cover and said lateral walls; said beam slidable in said passageway; wherein each said passageway comprises a top inner face and an opposite bottom inner bottom face, and a side face connecting said top inner face and said inner bottom face, the inner bottom face having a step portion or protrusion; and said beam having a protrusion downwardly; said beam slidable freely in a lower side of the step portion the protrusion mating with said step portion or protrusion for preventing further movement of beam in a higher side of the step portion, the beam leaning against said side face of said passageway; wherein said shell further comprises anchor portions extending from said lateral walls, a plurality of grooves disposed in the bottom of said dielectric base, said anchor portion received within said groove after said beam is slidable into the passageway.

2. The electrical card connector of claim 1, wherein the middle of said top cover is narrower than the end of it, and the outline of the cover varies smoothly and is formed as a crescent shape.

3. The electrical card connector of claim 1, wherein the dielectric base has a mating face, said mating face and the top cover defining a receiving room where a card inserted into, a plurality of terminals are disposed in the dielectric base, said terminals having arms stretchable into said receiving room.

4. An electrical connector comprising: an insulative housing defining two opposite side portions; a slot formed in a lateral external face of each of said side portions and facing outwardly in a lateral direction; a plurality of contacts disposed in the housing with contacting sections extending upwardly beyond a top face of the housing; and a metallic shell including a top wall with two opposite lateral walls downwardly from two opposite side edges of the top wall, each of said lateral walls forming a beam along a front-to-back direction perpendicular to said lateral direction; wherein said shell is assembled to the housing along said front-to-back direction so as to have said beam snugly received in the corresponding slot under condition that a card receiving space is formed between the top face of the housing and the top wall of the shell; wherein said beam is unitarily stamped inwardly from the corresponding lateral wall with two opposite ends linked thereto.

5. The electrical connector as claimed in claim 4, wherein said beam essentially lies in a vertical plane.

6. The electrical connector as clamed in claim 4, wherein each of said lateral wall further includes at least solder pad horizontally extending at a bottom edge thereof.

7. The electrical connector as claimed in claim 4, wherein at least one of said beam and the corresponding slot forms a protrusion thereon in a vertical direction perpendicular to both said lateral direction and said front-to-back direction.

* * * * *